US012084962B2

(12) United States Patent
Eitschberger

(10) Patent No.: US 12,084,962 B2
(45) Date of Patent: Sep. 10, 2024

(54) TANDEM SEAL ADAPTER WITH INTEGRATED TRACER MATERIAL

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 107 days.

(21) Appl. No.: 17/911,160

(22) PCT Filed: Mar. 15, 2021

(86) PCT No.: PCT/EP2021/056507
§ 371 (c)(1),
(2) Date: Sep. 13, 2022

(87) PCT Pub. No.: WO2021/185749
PCT Pub. Date: Sep. 23, 2021

(65) Prior Publication Data

US 2023/0115055 A1 Apr. 13, 2023

Related U.S. Application Data

(60) Provisional application No. 62/990,165, filed on Mar. 16, 2020.

(51) Int. Cl.
*E21B 47/11* (2012.01)
*E21B 33/12* (2006.01)
(Continued)

(52) U.S. Cl.
CPC ..... *E21B 47/11* (2020.05); *E21B 33/12* (2013.01); *E21B 43/117* (2013.01); *E21B 43/119* (2013.01)

(58) Field of Classification Search
CPC ..... E21B 27/02; E21B 43/117; E21B 43/119; E21B 47/11
See application file for complete search history.

(56) References Cited

U.S. PATENT DOCUMENTS 2,296,198 A 9/1942 Alexander
2,358,466 A 9/1944 Miller
(Continued)

FOREIGN PATENT DOCUMENTS

AU 741792 B2 12/2001
CA 2699869 A1 10/2011
(Continued)

OTHER PUBLICATIONS

U.S. Appl. No. 63/128,401, filed Dec. 21, 2020, Stefan Purcelean.
(Continued)

*Primary Examiner* — Jennifer H Gay
(74) *Attorney, Agent, or Firm* — Womble Bond Dickinson (US) LLP

(57) ABSTRACT

A tandem seal adapter for a perforating gun assembly includes a housing having a first end adapted to be connected to a first perforating gun and a second end adapted to be connected to a second perforating gun. A port extends through a wall of the housing and is in communication with an interior of the first perforating gun. A tracer material is arranged in the port, and a retainer secures the tracer material in the port. Upon detonation of the first perforating gun, the retainer is displaced and the tracer material is expelled from the port by gas pressure produced by the detonation. A corresponding method of using a tandem seal adapter to disperse tracer material into a wellbore and a tool string employing such a tandem seal adapter are also provided.

19 Claims, 9 Drawing Sheets

(51) Int. Cl.
*E21B 43/117* (2006.01)
*E21B 43/119* (2006.01)

(56) References Cited

U.S. PATENT DOCUMENTS 2,418,486 A 4/1947 Smylie
2,644,530 A 7/1953 Baker
2,732,800 A 1/1956 Coursen
2,736,261 A 2/1956 Davis et al.
2,742,857 A 4/1956 Turechek
2,889,775 A 6/1959 Owen
2,915,011 A * 12/1959 Hamill ..... E21B 43/117 166/212
3,119,178 A 1/1964 Owen et al.
3,158,680 A 11/1964 Lovitt et al.
3,170,400 A 2/1965 Nelson
3,173,992 A 3/1965 Boop
3,208,378 A 9/1965 Boop
3,213,414 A 10/1965 Moser
3,246,707 A 4/1966 Bell
3,255,659 A 6/1966 Venghiattis
3,303,884 A 2/1967 Medford
3,327,630 A 6/1967 Bell
3,374,735 A 3/1968 Moore
3,375,108 A 3/1968 Wyman et al.
3,493,061 A 2/1970 Gyongyosi
3,493,757 A * 2/1970 Glenn, Jr. ..... E21B 47/11 250/493.1
3,504,723 A 4/1970 Cushman et al.
3,589,453 A 6/1971 Venghiattis
3,675,575 A 7/1972 Bailey et al.
3,706,342 A 12/1972 Woolley
3,710,867 A 1/1973 Bansbach
3,713,334 A 1/1973 Vann et al.
3,777,663 A 12/1973 Brown
3,859,921 A 1/1975 Stephenson
3,923,105 A 12/1975 Lands
3,927,791 A 12/1975 Hershberger
4,007,790 A 2/1977 Henning
4,058,061 A 11/1977 Mansur, Jr. et al.
4,094,248 A 6/1978 Jacobson
4,182,216 A 1/1980 DeCaro
4,273,047 A 6/1981 Rommer
4,290,486 A 9/1981 Regalbuto
4,411,491 A 10/1983 Larkin et al.
D274,701 S 7/1984 Burrill
4,479,556 A 10/1984 Stout et al.
4,479,584 A 10/1984 Raz
4,491,185 A 1/1985 McClure
4,496,008 A 1/1985 Pottier et al.
4,523,650 A 6/1985 Sehnert et al.
4,566,544 A 1/1986 Bagley et al.
4,574,892 A 3/1986 Grigar et al.
4,598,775 A 7/1986 Vann et al.
4,605,074 A 8/1986 Barfield
4,619,333 A 10/1986 George
4,621,396 A 11/1986 Walker et al.
4,650,009 A 3/1987 McClure et al.
4,657,089 A 4/1987 Stout
4,660,910 A 4/1987 Sharp et al.
4,672,896 A 6/1987 Precoul et al.
4,678,044 A 7/1987 Luke et al.
4,744,424 A 5/1988 Lendermon et al.
4,747,201 A 5/1988 Donovan et al.
4,757,479 A 7/1988 Masson et al.
4,769,734 A 9/1988 Heinemeyer et al.
4,776,393 A 10/1988 Forehand et al.
4,790,383 A 12/1988 Savage et al.
4,800,815 A 1/1989 Appledom et al.
4,829,901 A 5/1989 Yates, Jr.
4,850,438 A 7/1989 Regalbuto
4,860,653 A 8/1989 Abouav
4,889,183 A 12/1989 Sommers et al.
4,898,245 A 2/1990 Braddick
5,027,708 A 7/1991 Gonzalez et al.
5,042,594 A 8/1991 Gonzalez et al.
5,052,489 A 10/1991 Carisella et al.
5,060,573 A 10/1991 Montgomery et al.
5,088,413 A 2/1992 Huber
5,098,487 A 3/1992 Brauer et al.
5,115,865 A 5/1992 Carisella et al.
5,159,145 A 10/1992 Carisella et al.
5,159,146 A 10/1992 Carisella et al.
5,191,936 A 3/1993 Edwards et al.
5,223,665 A 6/1993 Burleson et al.
5,248,055 A 9/1993 Sanai et al.
5,322,019 A 6/1994 Hyland
5,323,684 A 6/1994 Umphries
5,347,929 A 9/1994 Lerche et al.
5,379,845 A 1/1995 Blount et al.
5,383,405 A 1/1995 Everest
5,392,851 A 2/1995 Arend
5,392,860 A 2/1995 Ross
5,436,791 A 7/1995 Turano et al.
5,673,760 A 10/1997 Brooks et al.
5,703,319 A 12/1997 Fritz et al.
5,775,426 A 7/1998 Snider et al.
5,780,764 A 7/1998 Welch et al.
5,816,343 A 10/1998 Markel et al.
5,871,052 A 2/1999 Benson et al.
5,927,402 A 7/1999 Benson et al.
5,960,894 A 10/1999 Lilly et al.
D417,252 S 11/1999 Kay
6,006,833 A 12/1999 Burleson et al.
6,008,281 A 12/1999 Yang et al.
6,012,525 A 1/2000 Burleson et al.
6,044,905 A 4/2000 Harrison, III
6,085,659 A 7/2000 Beukes et al.
6,112,666 A 9/2000 Murray et al.
6,148,263 A 11/2000 Brooks et al.
6,173,651 B1 1/2001 Pathe et al.
6,257,792 B1 7/2001 Read, Jr.
6,263,283 B1 7/2001 Snider et al.
6,274,948 B1 8/2001 Blank et al.
6,305,287 B1 10/2001 Capers et al.
6,333,699 B1 12/2001 Zierolf
6,336,408 B1 1/2002 Parrott et al.
6,354,374 B1 3/2002 Edwards et al.
6,412,388 B1 7/2002 Frazier
6,418,853 B1 7/2002 Duguet et al.
6,439,121 B1 8/2002 Gillingham
6,446,558 B1 9/2002 Peker et al.
6,497,285 B2 12/2002 Walker
6,516,901 B1 2/2003 Falgout
6,564,866 B2 * 5/2003 Clark ..... E21B 47/11 166/250.12
6,651,747 B2 11/2003 Chen et al.
6,684,791 B1 2/2004 Barnhart
6,688,231 B1 2/2004 Herrmann
6,705,414 B2 3/2004 Simpson et al.
6,739,265 B1 5/2004 Badger et al.
6,742,602 B2 6/2004 Trotechaud
6,752,083 B1 6/2004 Lerche et al.
6,785,116 B1 8/2004 Hummel et al.
6,843,318 B2 1/2005 Yarbro
6,925,924 B2 8/2005 Baker et al.
6,938,689 B2 9/2005 Farrant et al.
7,000,699 B2 2/2006 Yang et al.
7,013,977 B2 3/2006 Nordaas
7,044,225 B2 5/2006 Haney et al.
7,073,580 B2 7/2006 Wilson et al.
7,107,908 B2 9/2006 Forman et al.
7,193,527 B2 3/2007 Hall
7,234,521 B2 6/2007 Shammai et al.
7,270,188 B2 9/2007 Cook et al.
7,278,491 B2 10/2007 Scott
7,301,750 B2 11/2007 DeVries et al.
7,451,703 B1 11/2008 Dabiri
7,455,104 B2 11/2008 Duhon et al.
7,522,103 B2 4/2009 Wood
7,533,722 B2 5/2009 George et al.
7,568,429 B2 8/2009 Hummel et al.
7,588,080 B2 9/2009 McCoy
7,591,212 B2 9/2009 Myers, Jr. et al.

(56) References Cited

U.S. PATENT DOCUMENTS 7,647,978 B2 1/2010 Scott
7,661,474 B2 2/2010 Campbell et al.
7,690,306 B1 4/2010 King
7,698,982 B2 4/2010 Bell
7,721,649 B2 5/2010 Hetz et al.
7,736,261 B2 6/2010 Wittkopp et al.
7,762,172 B2 7/2010 Li et al.
7,762,351 B2 7/2010 Vidal
7,775,273 B2 8/2010 Merlau et al.
7,778,006 B2 8/2010 Stewart et al.
7,802,619 B2 9/2010 Hurst et al.
7,810,430 B2 10/2010 Chan et al.
7,819,064 B2 10/2010 Saenger et al.
7,849,919 B2 12/2010 Wood et al.
7,908,970 B1 3/2011 Jakaboski et al.
7,929,270 B2 4/2011 Hummel et al.
8,061,425 B2 11/2011 Hales et al.
8,066,083 B2 11/2011 Hales et al.
8,069,789 B2 12/2011 Hummel et al.
8,079,296 B2 12/2011 Barton et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,220,394 B2 7/2012 Bates et al.
8,240,251 B2 8/2012 Waddell et al.
8,256,337 B2 9/2012 Hill et al.
8,322,284 B2 12/2012 Meddes et al.
8,336,437 B2 12/2012 Barlow et al.
8,360,161 B2 1/2013 Buytaert et al.
8,395,878 B2 3/2013 Stewart et al.
8,414,715 B2 4/2013 Altschuler et al.
8,451,137 B2 5/2013 Bonavides et al.
8,474,381 B2 7/2013 Streibich et al.
8,582,275 B2 11/2013 Yan et al.
8,661,978 B2 3/2014 Backhus et al.
8,695,506 B2 4/2014 Lanclos
8,726,995 B2 5/2014 Bell et al.
8,769,795 B2 7/2014 Kash et al.
8,807,206 B2 8/2014 Walker
8,807,213 B2 * 8/2014 Walker ..... E21B 43/116 175/2
8,813,841 B2 * 8/2014 Carisella ..... E21B 27/02 166/305.1
8,863,665 B2 10/2014 DeVries et al.
8,869,887 B2 10/2014 Deere et al.
8,875,787 B2 11/2014 Tassaroli
8,881,816 B2 11/2014 Glenn et al.
8,910,718 B2 12/2014 Watson et al.
8,931,569 B2 1/2015 Fagley et al.
8,985,023 B2 3/2015 Mason
9,045,692 B2 6/2015 Lumley
9,080,432 B2 7/2015 Yang et al.
9,080,433 B2 7/2015 Lanclos et al.
9,115,572 B1 8/2015 Hardesty et al.
9,145,763 B1 9/2015 Sites, Jr.
9,145,764 B2 9/2015 Burton et al.
9,157,718 B2 10/2015 Ross
9,175,553 B2 11/2015 McCann et al.
9,181,790 B2 11/2015 Mace et al.
9,194,219 B1 11/2015 Hardesty et al.
9,206,666 B2 12/2015 Hallundbæk et al.
9,206,675 B2 12/2015 Hales et al.
9,267,346 B2 2/2016 Robertson et al.
9,279,306 B2 3/2016 Baihly
9,291,039 B2 3/2016 King et al.
9,347,119 B2 5/2016 Xu
9,360,222 B1 6/2016 Collier
9,476,289 B2 10/2016 Wells
9,494,021 B2 11/2016 Parks et al.
9,518,443 B2 12/2016 Tunget et al.
9,518,454 B2 12/2016 Current et al.
9,574,416 B2 2/2017 Wright et al.
9,581,422 B2 2/2017 Preiss et al.
9,598,942 B2 3/2017 Wells et al.
9,605,937 B2 3/2017 Eitschberger et al.
D787,025 S 5/2017 Taylor et al.
9,671,201 B2 6/2017 Marya et al.
9,677,363 B2 6/2017 Schacherer et al.
9,689,223 B2 6/2017 Schacherer et al.
9,689,240 B2 6/2017 LaGrange et al.
9,702,680 B2 7/2017 Parks et al.
9,810,035 B1 11/2017 Carr et al.
9,810,048 B2 11/2017 Balun
9,822,597 B2 * 11/2017 Carisella ..... E21B 27/02
9,835,015 B2 12/2017 Hardesty
9,845,666 B2 12/2017 Hardesty et al.
9,874,083 B2 1/2018 Logan et al.
9,903,695 B1 2/2018 Goodman et al.
9,915,366 B2 3/2018 Kendricks
9,921,038 B2 3/2018 Weinhold
9,951,563 B2 4/2018 Beaton et al.
10,047,592 B2 8/2018 Burgos et al.
10,053,969 B2 8/2018 Castillo et al.
10,066,917 B1 9/2018 Youn et al.
10,072,477 B2 9/2018 Cooper et al.
10,077,641 B2 9/2018 Rogman et al.
10,100,612 B2 10/2018 Lisowski et al.
10,107,064 B2 10/2018 Richards et al.
10,119,358 B2 11/2018 Walton et al.
10,138,706 B2 11/2018 Baihly et al.
10,151,152 B2 12/2018 Wight et al.
10,151,181 B2 12/2018 Lopez et al.
10,174,595 B2 1/2019 Knight et al.
10,190,398 B2 1/2019 Goodman et al.
10,240,441 B2 3/2019 Geerts et al.
RE47,339 E 4/2019 Sites, Jr.
10,267,127 B2 4/2019 Geerts et al.
10,267,611 B2 4/2019 Lownds et al.
10,337,270 B2 7/2019 Carisella et al.
10,337,310 B2 7/2019 Bell et al.
10,376,955 B2 8/2019 Loehken
10,408,025 B2 9/2019 Harrington et al.
10,422,195 B2 9/2019 LaGrange et al.
10,429,161 B2 10/2019 Parks et al.
10,443,331 B1 10/2019 Andres et al.
10,472,938 B2 11/2019 Parks et al.
10,502,036 B2 12/2019 Spring
D873,373 S 1/2020 Hartman et al.
10,584,552 B2 3/2020 Cannon et al.
10,584,565 B2 3/2020 Golian et al.
10,597,956 B2 3/2020 Gaska et al.
10,612,332 B1 4/2020 Sage
10,612,343 B2 4/2020 Hess et al.
10,677,012 B2 6/2020 Oag et al.
10,683,703 B2 6/2020 Faircloth et al.
10,731,443 B2 8/2020 Kaenel et al.
10,731,444 B2 * 8/2020 Wells ..... E21B 43/116
10,815,775 B2 * 10/2020 Lauritzen ..... E21B 27/02
D903,064 S 11/2020 Mulhern et al.
10,844,678 B2 11/2020 Mickey et al.
10,851,613 B2 12/2020 Wroblicky et al.
10,871,050 B2 12/2020 Hearn et al.
D908,754 S 1/2021 Eitschberger
10,900,309 B2 1/2021 Robertson et al.
10,900,335 B2 1/2021 Knight et al.
10,907,429 B2 2/2021 Xu et al.
10,920,542 B2 2/2021 Robey et al.
10,927,650 B2 2/2021 Schultz et al.
10,934,795 B2 3/2021 Wells
10,941,625 B2 3/2021 Mickey
10,954,761 B2 3/2021 Kaenel et al.
10,982,513 B2 4/2021 Gupta et al.
D920,402 S 5/2021 Eitschberger
11,009,330 B2 5/2021 Saltarelli et al.
D921,858 S 6/2021 Fitschberger et al.
11,021,923 B2 6/2021 Mulhern et al.
11,047,189 B2 6/2021 Fernandes et al.
11,053,760 B2 7/2021 Baker et al.
11,053,782 B2 7/2021 Loehken et al.
11,054,233 B2 * 7/2021 Henke ..... F42C 9/06
11,125,057 B2 9/2021 Robey
11,136,866 B2 10/2021 Holodnak et al.
11,168,546 B2 11/2021 Melhus et al.

(56) References Cited

U.S. PATENT DOCUMENTS 11,215,041 B2 1/2022 Knight et al.
11,230,894 B1 1/2022 Shahid et al.
11,286,756 B2 3/2022 Harrigan et al.
11,306,547 B2 4/2022 Thomas
11,885,216 B2 * 1/2024 Lagrange ..... E21B 47/11
2002/0020320 A1 2/2002 Lebaudy et al.
2002/0062991 A1 5/2002 Farrant et al.
2002/0079098 A1 * 6/2002 Clark ..... E21B 43/11857 166/250.12
2002/0145423 A1 10/2002 Yoo
2002/0185275 A1 12/2002 Yang et al.
2002/0189482 A1 12/2002 Kneisl et al.
2003/0000411 A1 1/2003 Cernocky et al.
2003/0098158 A1 5/2003 George et al.
2004/0216632 A1 11/2004 Finsterwald
2004/0216633 A1 11/2004 Kash
2004/0216823 A1 11/2004 Dahlberg et al.
2004/0216866 A1 11/2004 Barlow et al.
2004/0216868 A1 11/2004 Owen
2004/0239521 A1 12/2004 Zierolf
2005/0011390 A1 1/2005 Jennings
2005/0115448 A1 6/2005 Pratt et al.
2005/0167101 A1 8/2005 Sugiyama
2005/0194146 A1 9/2005 Barker et al.
2005/0229805 A1 10/2005 Myers, Jr. et al.
2005/0230099 A1 10/2005 Thomson et al.
2005/0241824 A1 11/2005 Burris et al.
2005/0241825 A1 11/2005 Burris et al.
2005/0241835 A1 11/2005 Burris et al.
2006/0075889 A1 4/2006 Walker
2007/0084336 A1 4/2007 Neves
2007/0101889 A1 5/2007 Bayliss et al.
2007/0158109 A1 7/2007 Zazovsky et al.
2007/0267195 A1 11/2007 Grigar et al.
2008/0110632 A1 5/2008 Beall
2008/0134922 A1 6/2008 Grattan et al.
2008/0173204 A1 7/2008 Anderson et al.
2008/0264639 A1 10/2008 Parrott et al.
2008/0307875 A1 12/2008 Hassan et al.
2008/0314591 A1 12/2008 Hales et al.
2009/0050322 A1 2/2009 Hill et al.
2009/0139423 A1 6/2009 Dahlberg
2009/0151588 A1 6/2009 Burleson et al.
2009/0223668 A1 9/2009 Smart et al.
2009/0272529 A1 11/2009 Crawford
2009/0301723 A1 12/2009 Gray
2010/0000789 A1 1/2010 Barton et al.
2010/0024674 A1 2/2010 Peeters et al.
2010/0230163 A1 9/2010 Hales et al.
2010/0300750 A1 12/2010 Hales et al.
2011/0024116 A1 2/2011 McCann et al.
2011/0209871 A1 9/2011 Le et al.
2012/0006217 A1 1/2012 Anderson
2012/0152542 A1 6/2012 Le
2012/0160483 A1 * 6/2012 Carisella ..... E21B 27/02 166/373
2012/0177879 A1 7/2012 Cripsey et al.
2012/0226443 A1 9/2012 Cresswell et al.
2012/0227962 A1 9/2012 Richard
2012/0234780 A1 9/2012 Hokanson
2012/0241169 A1 9/2012 Hales et al.
2012/0242135 A1 9/2012 Thomson et al.
2012/0247769 A1 10/2012 Schacherer et al.
2012/0298361 A1 11/2012 Sampson
2013/0043074 A1 2/2013 Tassaroli
2013/0168083 A1 7/2013 McCarter et al.
2013/0199843 A1 8/2013 Ross
2013/0220614 A1 8/2013 Torres et al.
2013/0327571 A1 12/2013 Andrzejak
2014/0020896 A1 1/2014 Al-Gouhi
2014/0026776 A1 1/2014 Kecskes et al.
2014/0076542 A1 3/2014 Whitsitt et al.
2014/0131097 A1 * 5/2014 Walker ..... E21B 29/02 175/4.51
2014/0238678 A1 8/2014 Arrell, Jr. et al.
2014/0251612 A1 9/2014 Powers
2014/0314977 A1 10/2014 Weinhold
2015/0136419 A1 5/2015 Mauldin
2015/0226043 A1 8/2015 Hardesty et al.
2015/0226044 A1 8/2015 Ursi et al.
2015/0337648 A1 11/2015 Zippel et al.
2016/0003025 A1 1/2016 Beekman et al.
2016/0032711 A1 2/2016 Sheiretov et al.
2016/0053561 A1 2/2016 Carr et al.
2016/0061572 A1 3/2016 Eitschberger et al.
2016/0084048 A1 3/2016 Harrigan et al.
2016/0084075 A1 3/2016 Ingraham et al.
2016/0108722 A1 4/2016 Whitsitt et al.
2016/0131460 A1 5/2016 Marlin
2016/0160568 A1 6/2016 Randall
2016/0168942 A1 6/2016 Broome et al.
2016/0168961 A1 6/2016 Parks et al.
2016/0202027 A1 7/2016 Peterson et al.
2016/0202033 A1 7/2016 Shahinpour et al.
2016/0208587 A1 7/2016 Hardesty et al.
2016/0273902 A1 9/2016 Eitschberger
2016/0290084 A1 10/2016 LaGrange et al.
2016/0298404 A1 10/2016 Beckett et al.
2016/0305208 A1 10/2016 Jacob
2016/0320769 A1 11/2016 Deffenbaugh et al.
2016/0333675 A1 * 11/2016 Wells ..... E21B 47/092
2016/0369620 A1 12/2016 Pelletier et al.
2017/0016705 A1 1/2017 Jung et al.
2017/0030693 A1 2/2017 Preiss et al.
2017/0032653 A1 2/2017 Crawford et al.
2017/0051586 A1 2/2017 Wells et al.
2017/0052004 A1 2/2017 Xue
2017/0058648 A1 3/2017 Geerts et al.
2017/0138150 A1 5/2017 Yencho
2017/0158952 A1 6/2017 Nguyen et al.
2017/0175498 A1 6/2017 Segura
2017/0175500 A1 6/2017 Robey et al.
2017/0211381 A1 7/2017 Chemali
2017/0298716 A1 10/2017 McConnell et al.
2017/0314385 A1 11/2017 Hori et al.
2017/0370169 A1 12/2017 Genovese et al.
2018/0080298 A1 3/2018 Covalt et al.
2018/0087353 A1 3/2018 Skyler
2018/0100387 A1 4/2018 Kouchmeshky et al.
2018/0119529 A1 5/2018 Goyeneche
2018/0202790 A1 7/2018 Parks et al.
2018/0216446 A1 8/2018 Allison
2018/0231361 A1 8/2018 Wicks et al.
2018/0328703 A1 11/2018 Rensburg
2018/0363450 A1 12/2018 Legendre et al.
2018/0372460 A1 12/2018 Loehken et al.
2019/0071963 A1 3/2019 Sites
2019/0085685 A1 3/2019 McBride
2019/0100973 A1 * 4/2019 Lauritzen ..... E21B 23/01
2019/0162055 A1 5/2019 Collins et al.
2019/0162056 A1 5/2019 Sansing
2019/0195054 A1 6/2019 Bradley et al.
2019/0211655 A1 7/2019 Bradley et al.
2019/0234188 A1 8/2019 Goyeneche
2019/0257158 A1 8/2019 Langford et al.
2019/0257181 A1 8/2019 Langford et al.
2019/0264548 A1 8/2019 Zhao et al.
2019/0322342 A1 10/2019 Dabbous et al.
2019/0323810 A1 10/2019 Saltarelli et al.
2019/0330933 A1 10/2019 Mikalsen
2019/0330935 A1 10/2019 Mikalsen et al.
2019/0330936 A1 10/2019 Mikalsen et al.
2019/0330937 A1 10/2019 Mikalsen
2019/0338612 A1 11/2019 Holodnak et al.
2019/0368293 A1 12/2019 Covalt et al.
2020/0024934 A1 1/2020 Eitschberger et al.
2020/0024935 A1 1/2020 Eitschberger et al.
2020/0032626 A1 1/2020 Parks et al.
2020/0056442 A1 2/2020 Cherewyk et al.
2020/0063537 A1 2/2020 Langford et al.
2020/0088011 A1 3/2020 Eitschberger et al.
2020/0124584 A1 4/2020 Morgan et al.
2020/0157909 A1 5/2020 Fernandes et al.
2020/0157924 A1 5/2020 Melhus et al.

(56) References Cited

U.S. PATENT DOCUMENTS

| | | | | |
|---|---|---|---|---|
| 2020/0166320 | A1* | 5/2020 | Henke | E21B 43/1185 |
| 2020/0182025 | A1 | 6/2020 | Brady | |
| 2020/0199983 | A1 | 6/2020 | Preiss et al. | |
| 2020/0217629 | A1 | 7/2020 | Loehken et al. | |
| 2020/0263535 | A1 | 8/2020 | Roessler et al. | |
| 2020/0332630 | A1 | 10/2020 | Davis et al. | |
| 2020/0370421 | A1 | 11/2020 | Fripp et al. | |
| 2020/0378221 | A1 | 12/2020 | Harrigan et al. | |
| 2021/0172298 | A1 | 6/2021 | Knight et al. | |
| 2021/0198964 | A1 | 7/2021 | Mulhern et al. | |
| 2021/0198983 | A1 | 7/2021 | Eitschberger et al. | |
| 2021/0199002 | A1 | 7/2021 | Zemla et al. | |
| 2021/0215039 | A1 | 7/2021 | Scharf et al. | |
| 2021/0238966 | A1 | 8/2021 | Preiss et al. | |
| 2021/0277752 | A1 | 9/2021 | Eitschberger | |
| 2021/0277753 | A1 | 9/2021 | Ursi et al. | |
| 2021/0293107 | A1 | 9/2021 | Eitschberger | |
| 2021/0293121 | A1 | 9/2021 | Loehken et al. | |
| 2021/0301599 | A1 | 9/2021 | Mulhern et al. | |
| 2021/0301632 | A1 | 9/2021 | Loehken et al. | |
| 2021/0348485 | A1 | 11/2021 | Mauldin et al. | |
| 2021/0381348 | A1 | 12/2021 | Wuensche et al. | |
| 2022/0003054 | A1 | 1/2022 | Mikalsen et al. | |
| 2022/0018196 | A1 | 1/2022 | Gregg et al. | |
| 2022/0074289 | A1 | 3/2022 | Cardenas et al. | |
| 2022/0074718 | A1 | 3/2022 | Mcnelis | |
| 2022/0098947 | A1 | 3/2022 | Eitschberger | |
| 2022/0170727 | A1 | 6/2022 | Eitschberger | |
| 2022/0178230 | A1 | 6/2022 | Eitschberger et al. | |
| 2022/0381140 | A1* | 12/2022 | LaGrange | E21B 47/11 |
| 2022/0397376 | A1* | 12/2022 | Chen | F42B 1/032 |
| 2023/0003110 | A1* | 1/2023 | Ellis | E21B 34/14 |
| 2023/0115055 | A1* | 4/2023 | Eitschberger | E21B 43/119 175/4.57 |

FOREIGN PATENT DOCUMENTS

| | | | |
|---|---|---|---|
| CA | 2759705 | C | 10/2017 |
| CA | 3075858 | A1 | 3/2019 |
| CA | 3053174 | C | 1/2021 |
| CN | 1217784 | A | 5/1999 |
| CN | 1545609 | A | 11/2004 |
| CN | 101397890 | A | 4/2009 |
| CN | 201607180 | U | 10/2010 |
| CN | 102155202 | A | 8/2011 |
| CN | 102278098 | B | 9/2013 |
| CN | 104345214 | A | 2/2015 |
| CN | 208326704 | U | 1/2019 |
| CN | 106522886 | B | 12/2019 |
| CN | 211287646 | U | 8/2020 |
| CN | 111971453 | A | 11/2020 |
| CN | 212837726 | U | 3/2021 |
| CN | 214035607 | U | 8/2021 |
| CN | 214836284 | U | 11/2021 |
| DE | 1110108 | B | 7/1961 |
| EP | 0416915 | A2 | 3/1991 |
| EP | 0860581 | A1 | 8/1998 |
| EP | 822384 | B1 | 10/2001 |
| EP | 1345003 | A2 | 9/2003 |
| EP | 2598830 | A1 | 6/2013 |
| EP | 3568664 | A1 | 11/2019 |
| EP | 3144630 | B1 | 1/2020 |
| EP | 3245380 | B1 | 4/2020 |
| FR | 1595508 | A | 6/1970 |
| FR | 2573751 | A1 | 10/1987 |
| GB | 2457081 | A | 8/2009 |
| GB | 2530551 | A | 3/2016 |
| JP | 2006071236 | B | 3/2006 |
| KR | 20180008177 | A | 1/2018 |
| WO | 2010104634 | A3 | 11/2010 |
| WO | 2014035316 | A1 | 3/2014 |
| WO | 2015006869 | A1 | 1/2015 |
| WO | 2015179713 | A1 | 11/2015 |
| WO | 2016145420 | A1 | 9/2016 |
| WO | 2017029240 | A1 | 2/2017 |
| WO | 2019033183 | A1 | 2/2019 |
| WO | 2019098991 | A1 | 5/2019 |
| WO | 2019238410 | A1 | 12/2019 |

OTHER PUBLICATIONS

Canadian Intellectual Property Office; Office Action for CA Application No. 3,070,118; dated Nov. 17, 2021; 3 pages.
GB Intellectual Property Office, Search Report for App. No. GB 1700625.5; dated Jul. 7, 2017; 5 pgs.
INPI Argentina; Office Action for Application No. 20190101834; dated Aug. 22, 2022; 3 pages.
INPI Argentina; Office Action for Application No. 20190101835; dated Aug. 29, 2022; 3 pages.
Intellectual Property India, Office Action of IN Application No. 201647004496, dated Jun. 7, 2019, 6 pgs.
International Searching Authority; International Preliminary Report on Patentability of the International Searching Authority for PCT/EP2021/056507; mailed on Sep. 29, 2022; 8 pages.
Norwegian Industrial Property Office; Office Action and Search Report for NO App. 20160017; Jun. 15, 2017; 5 pages.
Norwegian Industrial Property Office; Office Action and Search Report for NO App. No. 20171759; Jan. 14, 2020; 6 pages.
Norwegian Industrial Property Office; Office Action for NO Application No. 20180507; dated Sep. 29, 2022; 2 pages.
Owens Oil Tools, E & B Select Fire Side Port Tandem Sub Assembly Man-30-XXX-0002-96, revised Dec. 2012, 9 pgs., https://www.corelab.com/owen/CMS/docs/Manuals/gunsys/MAN-30-XXX-0002-96-R00.pdf.
United States Patent and Trademark Office, Office Action of U.S. Appl. No. 16/585,790, dated Nov. 12, 2019, 9 pgs.
United States Patent and Trademark Office, Office Action of U.S. Appl. No. 29/733,080, dated Jun. 26, 2020, 8 pgs.
United States Patent and Trademark Office; Ex Parte Quayle Action for U.S. Appl. No. 17/352,728; dated Jun. 20, 2022; 6 pages.
United States Patent and Trademark Office; Final Office Action for U.S. Appl. No. 16/809,729; dated Nov. 18, 2021; 16 pages.
United States Patent and Trademark Office; Final Office Action for U.S. Appl. No. 17/221,219; dated Aug. 24, 2021; 14 pages.
United States Patent and Trademark Office; Final Office Action for U.S. Appl. No. 17/352,728; dated Mar. 9, 2022; 9 pages.
United States Patent and Trademark Office; Non-Final Office Action for U.S. Appl. No. 16/540,484; dated Aug. 9, 2021; 12 pages.
United States Patent and Trademark Office; Non-Final Office Action for U.S. Appl. No. 16/809,729; dated Feb. 3, 2022; 6 pages.
United States Patent and Trademark Office; Non-Final Office Action for U.S. Appl. No. 16/809,729; dated Jun. 22, 2021; 15 pages.
United States Patent and Trademark Office; Non-Final Office Action for U.S. Appl. No. 17/007,574; dated May 6, 2022; 10 pages.
United States Patent and Trademark Office; Non-Final Office Action for U.S. Appl. No. 17/221,219; dated Aug. 3, 2022; 8 pages.
United States Patent and Trademark Office; Non-Final Office Action for U.S. Appl. No. 17/221,219; dated Jun. 17, 2021; 10 pages.
United States Patent and Trademark Office; Non-Final Office Action for U.S. Appl. No. 17/352,728; dated Oct. 25, 2021; 9 pages.
United States Patent and Trademark Office; Notice of Allowance for U.S. Appl. No. 15/920,812; dated Aug. 4, 2021; 5 pages.
United States Patent and Trademark Office; Notice of Allowance for U.S. Appl. No. 16/809,729; dated Sep. 21, 2022; 7 pages.
United States Patent and Trademark Office; Notice of Allowance for U.S. Appl. No. 17/007,574; dated Sep. 26, 2022; 8 pages.
United States Patent and Trademark Office; Notice of Allowance for U.S. Appl. No. 17/352,728; dated Sep. 21, 2022; 8 pages.
International Searching Authority; International Search Report and Written Opinion of the International Searching Authority for PCT/EP2021/056507; mailed on Jun. 30, 2021; 11 pages.

* cited by examiner

TANDEM SEAL ADAPTER WITH INTEGRATED TRACER MATERIAL

CROSS-REFERENCE TO RELATED APPLICATIONS

This application is a national stage application of and claims priority to Patent Cooperation Treaty (PCT) Application No. PCT/EP2021/056507 filed Mar. 15, 2021, which claims the benefit of U.S. Provisional Application No. 62/990,165 filed on Mar. 16, 2020, each of which is incorporated herein and made a part hereof by reference for all purposes.

BACKGROUND

Hydrocarbons, such as fossil fuels (e.g., oil) and natural gas, are extracted from underground wellbores extending deeply below the surface using complex machinery and explosive devices. Once the wellbore is established by placement of casing pipes after drilling and cementing the casing pipe in place, wellbore tools are lowered into the wellbore, and positioned adjacent one or more hydrocarbon reservoirs in underground formations.

The wellbore tools used in oil and gas operations are often sent down a wellbore in tool strings which are comprised of multiple discrete wellbore tools, or modules, connected together to consolidate different or multiple wellbore operations into a single "run", or process of sending wellbore tools downhole to perform one or more operations. This approach contributes to time and cost savings because preparing and deploying a wellbore tool into a wellbore and pumping, with fluid under hydraulic pressure, the wellbore tool to a particular location in a wellbore that may be a mile or more under the ground requires a great deal of time, energy, and manpower. Additional time, manpower, and costs are required to conduct the operation and remove the spent wellbore tool(s) from the wellbore.

Wellbore tools, or "downhole tools", as known and/or according to this disclosure include, without limitation, perforating guns, puncher guns, logging tools, jet cutters, plugs, frac plugs, bridge plugs, setting tools, self-setting bridge plugs, self-setting frac plugs, mapping/positioning/orientating tools, bailer/dump bailer tools and ballistic tools. Many of these wellbore tools contain sensitive or powerful explosives because many wellbore tools are ballistically (i.e., explosively) actuated or perform ballistic operations within the wellbore. Additionally, certain wellbore tools may contain, among other things, sensitive electronic control components and connections within the wellbore tool that control various operations of the wellbore tool. Explosives, control systems, and other components of wellbore tools may be incredibly sensitive to conditions within the wellbore including the high pressures and temperatures, fluids, debris, etc. In addition, wellbore tools that have explosive activity may generate tremendous amounts of ballistic and gas pressures within the wellbore tool itself. Accordingly, to ensure the integrity and proper operation of wellbore tools connected together as part of the tool string, connections between adjacent wellbore tools within the tool string must not only connect adjacent wellbore tools in the tool string, they must, in many cases, seal internal components of the wellbore tools from the wellbore conditions and pressure isolate adjacent modules against ballistic forces.

A tandem seal adapter (TSA) is a known connector often used for accomplishing the functions of a connector as described above, and in particular for connecting adjacent perforating gun modules. A perforating gun is an exemplary, though not limiting, wellbore tool that may include many of the features and challenges described above. A perforating gun carries explosive charges/shaped charges into the wellbore to perform perforating operations by which the shaped charges are detonated in a manner that produces perforations in a surrounding geological hydrocarbon formation from which oil and gas may be recovered. Conventional perforating guns often include electric componentry to control positioning and detonation of the explosive charges.

Shaped charges typically serve to focus ballistic energy onto a target, thereby producing a round perforation hole (in the case of conical shaped charges) or a slot-shaped/linear perforation (in the case of slot shaped charges) in, for example, a steel casing pipe or tubing, a cement sheath and/or a surrounding geological formation. In order to make these perforations, shaped charges typically include an explosive/energetic material positioned in a cavity of a housing (i.e., a shaped charge case), with or without a liner positioned therein. It should be recognized that the case, casing or housing of the shaped charge is distinguished from the casing of the wellbore, which is placed in the wellbore after the drilling process and may be cemented in place in order to stabilize the borehole prior to perforating the surrounding formations. Often, the explosive materials positioned in the cavity of the shaped charge case are selected so that they have a high detonation velocity and pressure. When the shaped charges are initiated, the explosive material detonates and creates a detonation wave, which will generally cause the liner (when used) to collapse and be ejected/expelled from the shaped charge, thereby producing a forward moving perforating material jet that moves at a high velocity. The perforating jet travels through an open end of the shaped charge case which houses the explosive charge, and serves to pierce the perforating gun body, casing pipe or tubular and surrounding cement layer, and forms a cylindrical/conical tunnel in the surrounding target geological formation.

In order to confirm that the formation has been perforated and fractured efficiently and that hydrocarbons are being recovered, flow indicators are sometimes included in a perforating gun in an effort to release the flow indicators into the wellbore or formation upon detonation of one or more of the shaped charges in the perforating gun. Flow indicators, sometimes referred to as tracers, can also be used in the oil and gas industry in order to qualitatively or quantitatively gauge how fluid flows through the reservoir, as well as being a useful tool for estimating residual oil saturation.

Typical flow indicators are incorporated as part of a perforating gun housing or a shaped charge housed in the perforating gun housing and are purposed to flow in the wellbore fluid, up to the surface of the wellbore, so they can serve as an indicator that perforations have been formed in the wellbore and reached the formation. Such flow indicators may also serve to indicate where the flow is coming from and/or where fracturing has occurred. In typical prior art configurations, the perforation jet of a shaped charge pierces through a flow indicator material, or the charge itself includes a flow indicator. Because of this arrangement, the heat and/or energy generated upon detonation of the shaped charge potentially manipulates the flow indicator, which can lead to an inaccurate determination at the well site. The indicator material may become damaged from the sudden pressure impact or the extremely high temperature of the explosive force created upon detonation of the shaped charge. In addition, some indicator material may remain on the rim order edge of the gun scallop or on the casing hole and not reach the actual formation, which may be influence the accuracy of the flow indicator readings at the wellbore surface.

A general, exemplary connection between adjacent perforating gun modules connected by a TSA according to the prior art is shown in FIG. 1. The configuration of the assembly in FIG. 1 is a simplified and representative cross-sectional illustration intended to aid in the disclosure and without reference or limitation to any prior art design(s).

As shown in FIG. 1, the representative assembly 100 includes a first perforating gun 101 and a second perforating gun 102 connected by a TSA 50. Each of the first perforating gun 101 and the second perforating gun 102 includes a perforating gun body 30, 31 enclosing an interior portion 40, 41 of the perforating gun 101, 102 where internal components of each perforating gun 101, 102 may be housed. The TSA 50 is positioned between and extends respectively at opposing ends into a portion of the interior 40, 41 of each of the first perforating gun 101 and the second perforating gun 102. The TSA 50 is connected to each of the first perforating gun 101 and the second perforating gun 102 by threaded connections 42 between an external threaded portion of the TSA 50 and an internal threaded portion of the perforating gun body 30, 31. A central portion 80 of the TSA 50 is positioned between two sealing elements 12, such as o-rings, that provide a seal about a junction 81 between the respective gun bodies 30, 31 which abut when fully screwed onto the TSA 50. The TSA 50 includes a through-bore 82 allowing electrical relays to pass between adjacent perforating guns 101, 102, and such through—bore 82 is typically sealed to pressure seal the adjacent perforating guns 101, 102 from each other.

Accordingly, there is a need for a mechanism of deploying tracer material into a wellbore upon detonation of a shaped charge such that the tracer material is not manipulated by the shaped charge. The present invention overcomes the disadvantages of the prior art by removing the tracer material from a direct impact by the shaped charge.

BRIEF DESCRIPTION

Embodiments of the disclosure are associated with a tandem seal adapter for a perforating gun assembly. The tandem seal adapter includes a housing having a first end and a second end spaced apart from the first end. According to an aspect, the first end is adapted to be connected to a first perforating gun and the second end is adapted to be connected to a second perforating gun. A port extends through a wall of the housing, from an exterior of the housing to an interior of the housing. The port is configured to be in communication with an interior of the first perforating gun. According to an aspect, a tracer material is arranged in the port, and a retainer secures the tracer material in the port. Upon detonation of the first perforating gun, gas pressure generated by the detonation displaces the retainer and the tracer material is expelled from the port.

Embodiments of the disclosure may be associated with a method of using a tandem seal adapter for a perforating gun assembly to disperse tracer material into a wellbore. The method includes connecting at least a first perforating gun to a tandem seal adapter. A tracer material is positioned in a port which extends through a housing of the tandem seal adapter. According to an aspect, the port extending through a wall of the housing from an exterior of the housing to an interior of the housing and is in communication with an interior of a first perforating gun. The tracer material is secured in the port by a retainer. The method further includes detonating a shaped charge in the first perforating gun, which creates a pressure sufficient to displace the retainer and expel the tracer material out of the port and into the wellbore.

Further embodiments of the disclosure are associated with a tool string including a plurality of perforating guns. Each perforating gun of the plurality of perforating guns includes at least one shaped charge and a tandem seal adapter positioned between every two adjacent perforating guns of the plurality of perforating guns. According to an aspect, the tandem seal adapter includes a housing having a first end adapted to be connected to a first perforating gun of the plurality of perforating guns and a second end adapted to be connected to a second perforating gun of the plurality of perforating guns. A port extends through a wall of the housing from an exterior of the housing to an interior of the housing. The port is in communication with an interior of the first perforating gun and a tracer material is arranged in the port. According to an aspect, a retainer is poisoned in the port, such that the tracer material is secured in the port. Upon detonation of the first perforating gun, gas pressure produced by the detonation displaces the retainer and expels the tracer material from the port.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
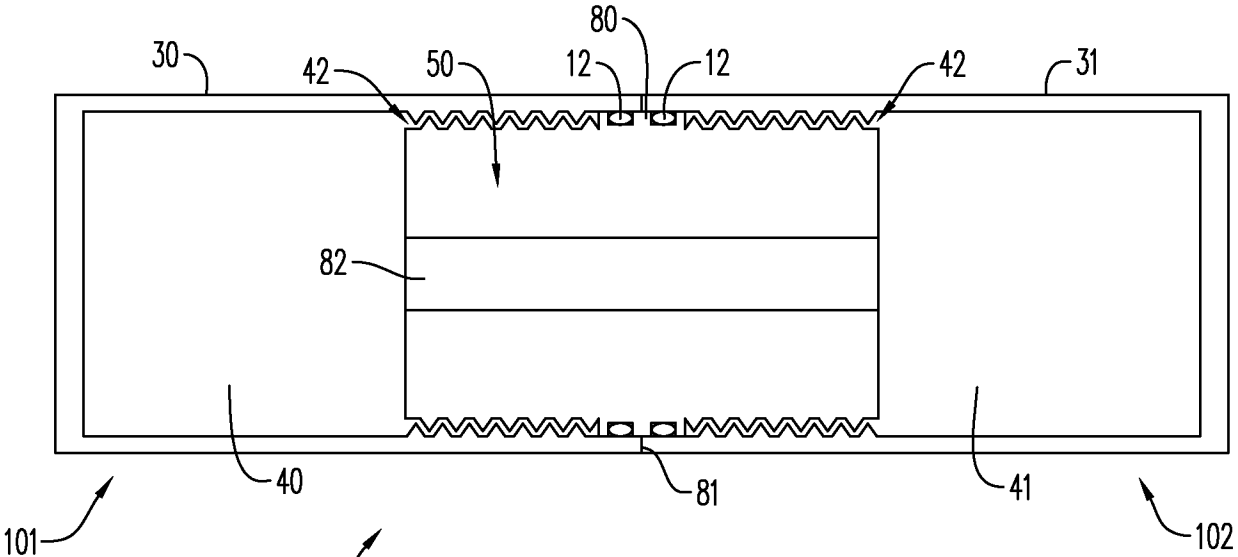
FIG. 1 (PRIOR ART)
FIG. 1 is a cross-sectional view of a tandem seal adapter assembly, according to the prior art.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

DETAILED DESCRIPTION

The headings used herein are for organizational purposes only and are not meant to limit the scope of the disclosure or the claims.

Reference will now be made in detail to various embodiments. Each example is provided by way of explanation and is not meant as a limitation and does not constitute a definition of all possible embodiments.

Figure 2:
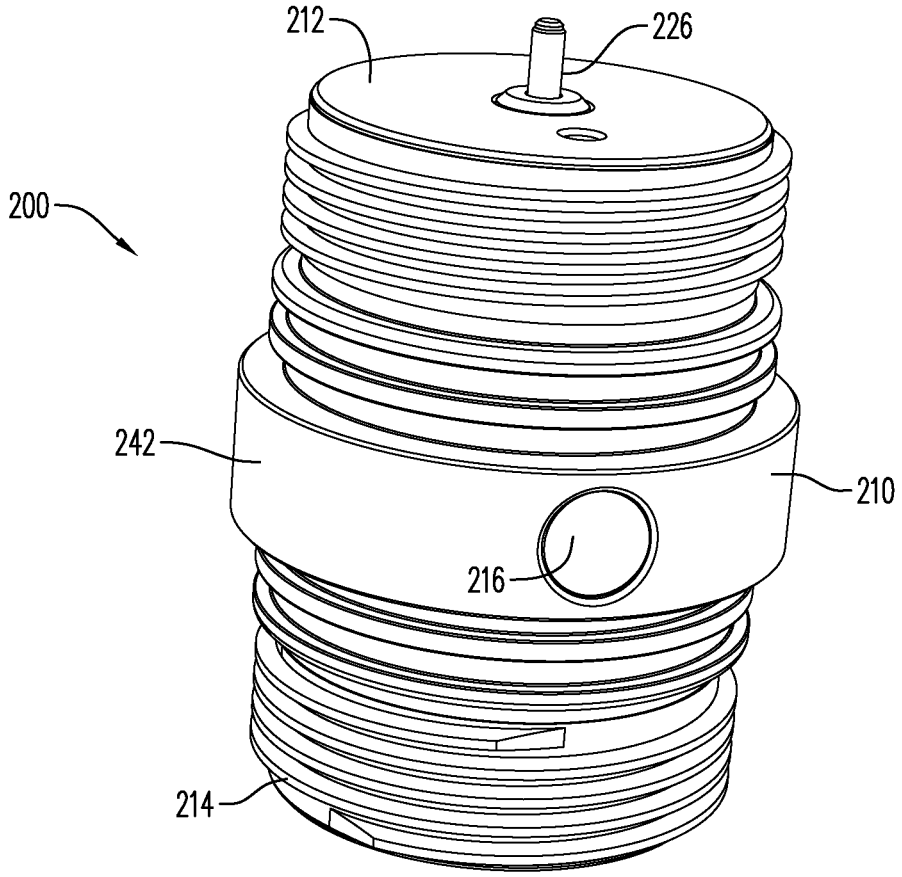
FIG. 2 is a perspective view of a tandem seal adapter, according to an embodiment.

Embodiments of the disclosure are associated with a tandem seal adapter/tracer sub assembly (TSA) 200. The TSA 200 is illustrated in FIG. 2. According to an aspect, the TSA 200 includes a housing 210 having a first end 212 and a second end 214 spaced apart from the first end 212. A rib 242 may extend around a circumference of the TSA 200, between at least a portion of the first end 212 and the second end 214. The first and second ends 212, 214 may each be adapted to be connected to a perforating gun assembly.

Figure 3A:
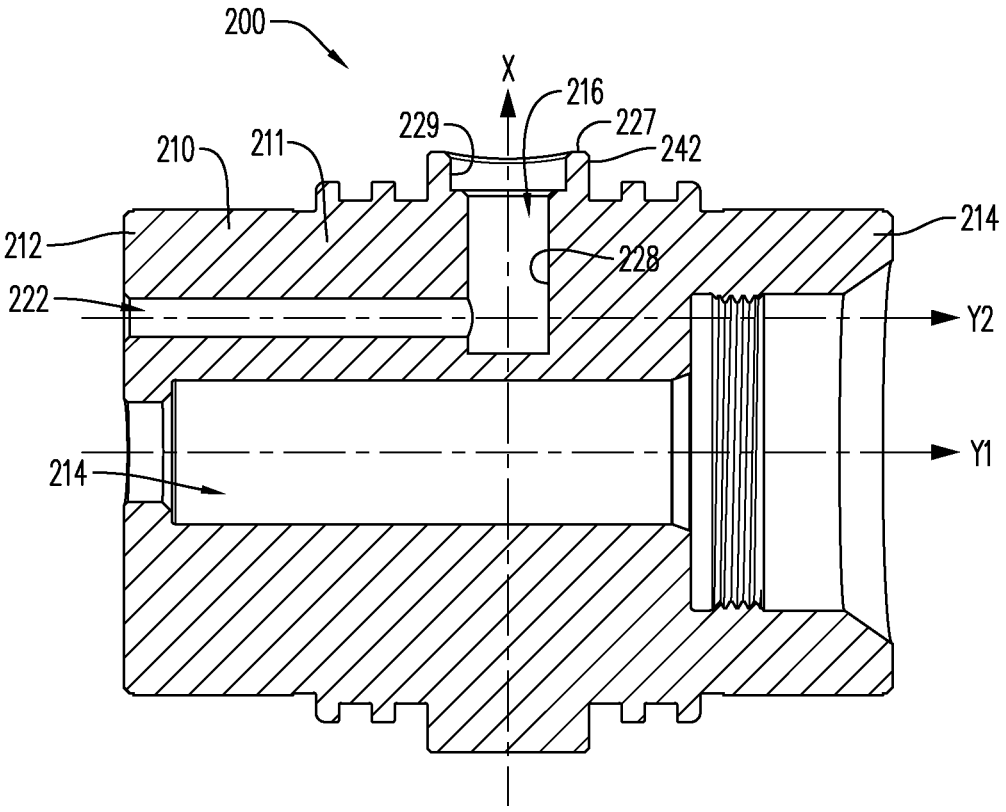
FIG. 3A is a cross-sectional view of a tandem seal adapter, according to an embodiment.
Figure 3B:
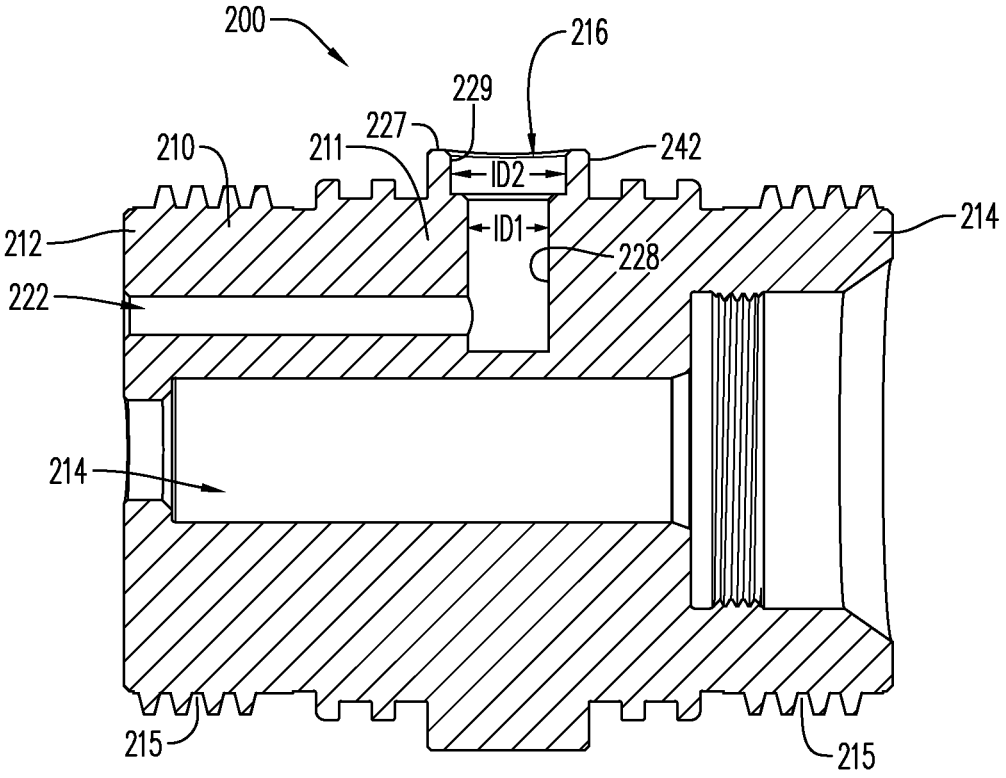
FIG. 3B is a cross-sectional view of a tandem seal adapter, according to an embodiment.

The TSA 200 is illustrated in further detail in FIG. 3A and FIG. 3B. As illustrated in FIG. 3A, the first and second end 212, 214 may be receivable within an interior portion of a perforation gun. It is contemplated that the first end 212 and the second end 214 may include a connecting element to connect the TSA 200 to adjacent perforating gun housings. According to an aspect, the connection element includes a threaded connection. FIG. 3B illustrates the first end 212 and the second end 214 of the TSA 200 including threads 215. The threads 215 may mechanically couple with corresponding threads of the adjacent perforating gun housings.

The TSA 200 may include a cavity 224 extending along a longitudinal direction Y1 of the housing 210, between the first end 212 and the second end 214. According to an aspect, the cavity 224 extends from the first end 212 to the second end 214. The cavity 224 may be configured to receive one or more electrical components to facilitate the transmission of an electrical signal between connected perforating gun assemblies.

According to an aspect and as further illustrated in FIGS. 3A-3B, the TSA 200 may further include a pathway 222 extending from the first end 212 of the housing 210. The pathway 222 may also extend along a longitudinal direction Y2 of the housing 210. According to an aspect, the pathway 222 extends parallel to and spaced apart from the cavity 224.

Figure 6:
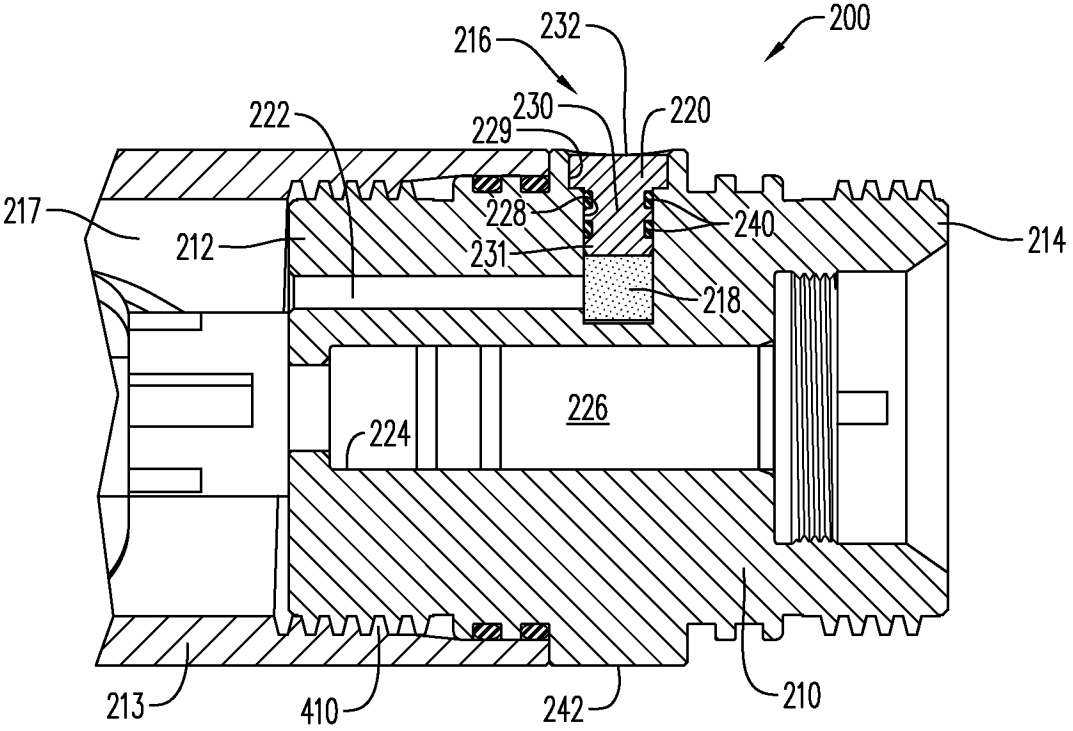
FIG. 6 is a cross-sectional view of a tandem seal adapter according to an embodiment.

A port 216 extends through a wall 211 of the housing to the pathway 222. According to an aspect, the port 216 radially extends from the pathway 222. As illustrated in FIG. 3A, the port 216 may intersect the pathway 222. The pathway 222 connects the port 216 to the interior of a perforating gun connected to the first end 212 of the TSA 200 (FIG. 6). According to an aspect, the port 216 includes a first radial bore 228 and a second radial bore 229. The first radial bore 228 extends from the pathway 222, while the second radial bore 229 extends from the first radial bore 228 to an external surface 227 of the housing 210. According to an aspect and as illustrated in FIG. 3B, the second radial bore 229 has an inner diameter ID2 that is larger than the inner diameter ID1 of the first radial bore 228.

In a further aspect, the tandem seal adapter 200 may comprise a rib 242 extending radially from the wall 211 of the housing 210. The rib 242 may project from the external surface 227 of the housing 210, between the first end 212 and the second end 214 of the housing 210. According to an aspect the port 216 extends through a portion of the rib 242.

Figure 4:
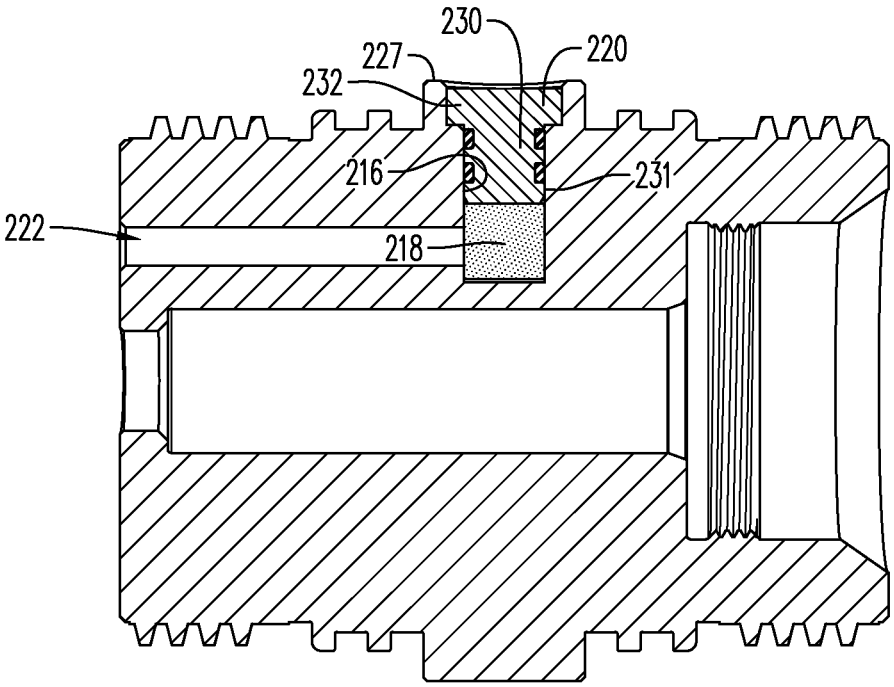
FIG. 4 is a cross-sectional view of a tandem seal adapter, including a tracer material and a plug, according to an embodiment.

FIG. 4 illustrates the TSA 200 including a tracer material 218. The tracer material 218 is positioned in portion of the port 216. According to an aspect, the tracer material is positioned in the first radial bore 228 of the port 216, such that the tracer material 218 is adjacent the pathway 222. The tracer material 218 may be perpendicular to the pathway 222. According to an aspect, the tracer material 218 may include a solid material secured in the port. The tracer material 218 may be formed from a dissolvable material that, when exposed to wellbore fluids, dissolves and is detectable in the wellbore or formation fluid. When displaced from the port, the tracer material is exposed to the wellbore fluids and may be carried to the surface of the wellbore, via hydrocarbons or the wellbore fluids. According to an aspect, the tracer 218 includes at least one of a dissolvable material. According to an aspect, the tracer 218 includes a small insoluble radioactive plastic sphere, which can be employed to perform a tracer loss measurement in water injector wells. The sphere or a plurality of spheres is designed to have the same density as the injection fluid so that the sphere travels along with the fluid when it is placed into the flow stream of an injection well. Typically, the radioactive beads do not enter the actual formation, but rather remain on the rock face in an open-hole scenario (non-cased) or somewhere within the perforation channel in a cased hole scenario.

According to a further aspect and as illustrated in FIG. 4, a retainer/plug 220 is positioned in the port, adjacent the tracer material 218, thus retaining the tracer material 218 within the port 216. At least a portion of the retainer 220 may be exposed to the wellbore. In an embodiment, the portion of the retainer 220 exposed to the wellbore is configured to withstand the wellbore environment, so that prolonged exposures to the wellbore will not cause wear and tear of the retainer 220. The retainer 220 may be inserted into the port 216 from the external surface 227 of the housing 210. To ensure that no wellbore fluids enters the port 216, one or more sealing members 240 may be secured to the retainer and positioned in the port 216. The sealing members 240 may comprise O-rings or the like.

According to an aspect, the retainer 220 is at least temporarily secured within the port 216. The retainer 220 may be press fit into the port 216. As seen for instance in FIG. 5A and FIG. 5B, the retainer 220 includes a head portion 232 and a body portion 230 extending from the head portion 232. According to an aspect, the head portion 232 has an outer diameter OD1 that is larger than an outer diameter OD2 of the body portion 230. As seen, for instance in at least FIGS. 4 and 6, the body portion 230 may extend, at least partially, into the first radial bore 228 and the head portion 232 may extend within the second radial bore 229 of the port 216. The outer diameter OD1 of the head portion 232 may be selected so that the head portion 232 is too large to be received into the first radial bore 228. This helps to ensure proper assembly of the retainer 220 and may also help to ensure that the tracer material 218 is retained in the port 216.

Figure 5A:
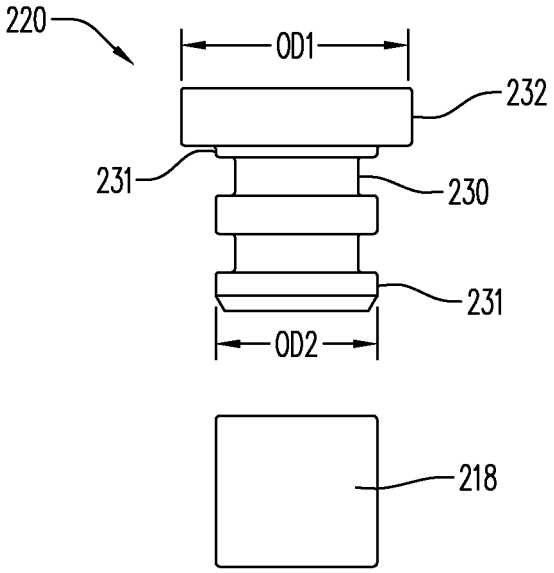
FIG. 5A is a perspective view of a tracer material and a plug, according to an embodiment.
Figure 5B:
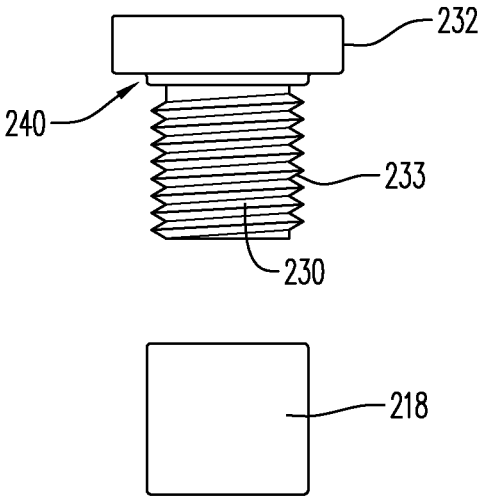
FIG. 5B is a perspective view of a plug, according to an embodiment.

The retainer 220 may be mechanically fastened in the port 216. According to an aspect and as illustrated in FIG. 5A, the body portion 230 includes one or more protrusions 231 that interact with an inner wall of the first radial bore 228. The protrusions 231 may facilitate the retention of the retainer 220 within the port 216. The protrusions 231 may be deformable so that they bend and flex in order for the body portion 230 to be positioned in the port 216 (FIG. 4 and FIG. 6). Alternatively and as illustrated in FIG. 5B, the body portion 230 includes a thread configured to interact with a threaded inner surface (not shown) of first radial bore 228 of the port 216. The head portion 232 may include a thread to interact with a threaded inner surface (not shown) of the second radial bore 229 of the port 216.

Figure 8:
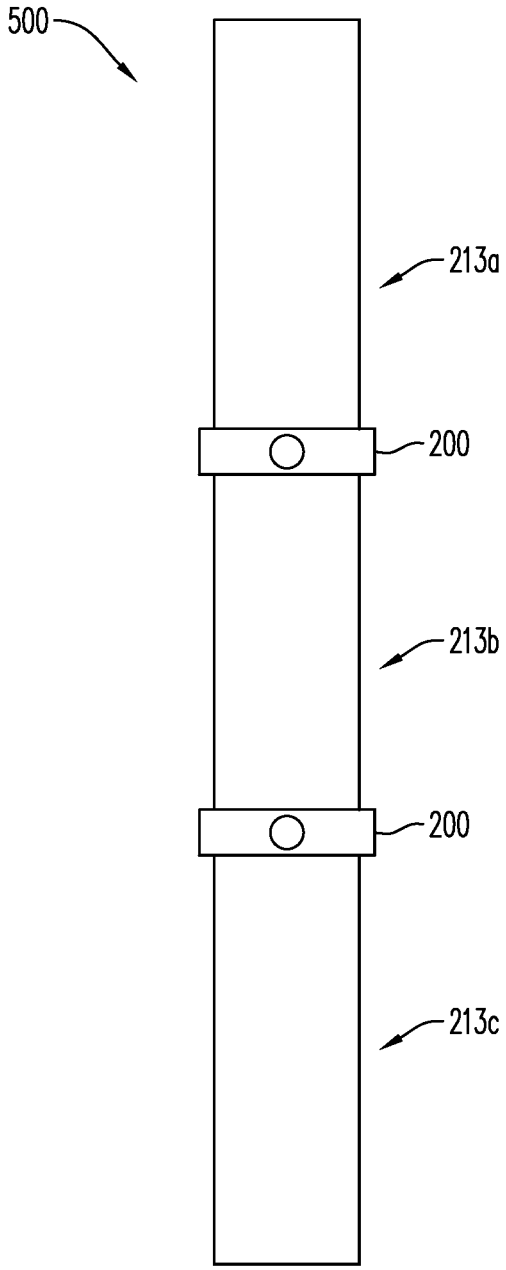
FIG. 8 is a side view of a tool string including a plurality of perforating guns connected by a plurality of tandem seal adapters, according to an embodiment.

As shown in FIG. 6, an exemplary embodiment of a TSA 200 for a perforating gun assembly may include a housing 210 having a first end 212 adapted to be connected to a first perforating gun 213A and a second end 214 adapted to be connected to a second perforating gun 213B (FIG. 8). The TSA may be configured substantially as described hereinabove with respect to FIGS. 2-4, thus for purposes of convenience and not limitation, all of the various features of the TSA 200 are not repeated hereinbelow.

As illustrated in FIG. 6, the TSA 200 includes a port 216 extending through a wall 211 of the housing 210. The port 216 intersects with a pathway 222 extending from the first end of the housing 212 and in communication with an interior of the first perforating gun 213A. Upon detonation of one or more shaped charges (FIG. 7) secured within the interior of a housing of the perforating gun 213A, pressurized gas from the detonation travels along the pathway 222 towards the tracer material 218. The pressurized gas forces the tracer material 218 and the retainer 220 out of the port 216 and into the wellbore. While the retainer 220 is pressure resistant against pressures towards an interior of the housing 210, and is adapted to maintain a pressure rating of the first perforating gun 213A, the detonation of the shaped charges generates a pressure that is greater than the atmospheric pressure of the perforating gun 213A and that can displace and expel the tracer material 218 and the retainer 220 from the TSA 200. The pressure rating of the perforation gun may me about 20,000 psi, while the wellbore pressure is between about 5,000 psi and about 15,000 psi. Other housings connected with the perforating of the TSA 200, such as a frac plug or bridge plug, are configured to maintain a pressure differential of 10,000 psi. The retainer 220 is geometrically designed so that it only maintains pressure in one direction.

In use, when a perforating gun 213 connected to the TSA 200 is detonated (see, for example, FIG. 7), the interior space 217 of the perforating gun housing is in open communication with the path 222 of the TSA 200. Perforating guns, as understood by one of ordinary skill in the art, typically include a detonator 406 in communication with a detonating cord 404 and an internal gun feedthrough (e.g., an electrical feedthrough or through wire). The detonating cord 404 is connected to one or more shaped charges 402 secured within the interior 217 of a housing of the perforating gun 213. When a shaped charge 402 of a perforating gun 213 connected to the TSA 200 is detonated, a gas pressure is generated by the detonation of the shaped charge 402 of the perforating gun 213. This gas pressure moves into the path 222 and forces the retainer 220 to eject from the port 216 so that the tracer material 218 is exposed to the wellbore environment. The tracer material 218 will also be ejected into the wellbore, without any structural damage to the tracer material 218.

Figure 7:
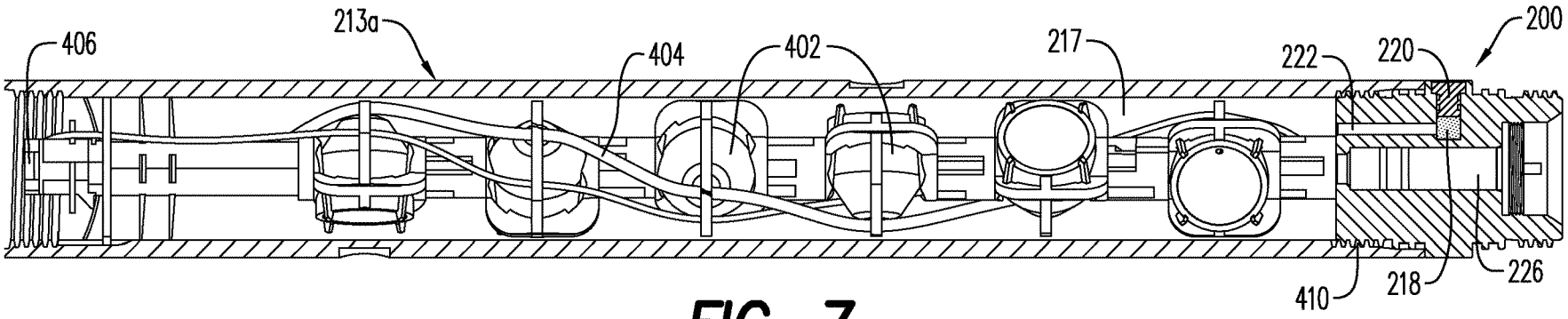
FIG. 7 is a cross-sectional view of a perforating gun connected to the tandem seal adapter of FIG. 6.

An exemplary embodiment of a method of using a TSA for a perforating gun assembly to disperse tracer material into a wellbore is also provided. FIG. 7 an example perforating gun assembly 300 including the TSA of FIGS. 2-4 and FIG. 6. The perforating gun assembly 300 includes a perforating gun 213A having one or more shaped charges 402 positioned therein. When more than one shaped charge 402 is included, the shaped charges 402 may be ballistically connected by a detonative device. The detonative device may include a booster, initiation pellets or a detonating cord. FIG. 6 illustrates the shaped charges 402 being connected by a detonating cord 404, which is connected to a detonator 406, as is known in the art.

The method includes connecting at least a first perforating gun 213 to a tandem seal adapter 200 (e.g., via a threaded connection 410), providing tracer material 218 in a port 216 which extends through a housing 210 of the tandem seal adapter 200. As described hereinabove, the port 216 extends through a wall 211 of the housing 210 from an exterior of the housing to an interior of the housing 210, and is in communication with an interior 217 of the first perforating gun 213A. A pathway 222 may extends from the first end 212 of the housing to the port 216 for connecting the port 216 to the interior 217 of the first perforating gun 213. The method may further include securing the tracer material 218 within the port 216 with a retainer 220. A shaped charge 402 in the first perforating gun 213A is detonated, which creates a pressure sufficient to displace the retainer 220 and expel the tracer material 218 from the TSA 200. According to an aspect, pressurized gas from the detonation may travel along the pathway 222 to the port 216, out of the port 216 and into the wellbore.

According to a further aspect, the method may further include providing a cavity 224 which extends within the housing 210 between the first end 212 and the second end 214, and pressure sealing the first perforating gun 213A from a second perforating gun 213B. The step of pressure sealing the first and second perforating guns 213A, 213B includes positioning a pressure bulkhead/bulkhead 226 within the cavity 224 of the TSA 200. The bulkhead 226 may include sealing elements, such as o-rings, to help to seal/isolate the components housed in the first perforating gun 213A from components housed in the second perforating gun 213B, as seen for instance in FIG. 8.

The bulkhead 226 may be configured as a rotatable bulkhead assembly. Such bulkhead assemblies are described in U.S. Pat. No. 9,784,549, commonly owned and assigned to DynaEnergetics Europe, which is incorporated herein by reference in its entirety. The bulkhead 226 includes a bulkhead body having a first end and a second end. A first electrically contactable bulkhead component such as a metal contact plug or the elongated pin, extends from the first end of the bulkhead body, and a second electrically contactable bulkhead component, such as a downhole facing pin, extends from the second end of the bulkhead body. One or more sealing elements, such as O-rings, extends around the bulkhead body. The o-ring/(s) may be compressively engage an inner surface of the cavity 224 of the TSA 200 so that a pressure seal is maintained between the first perforating gun 213A and the second perforating gun 213B.

According to an aspect, the bulkhead 226 is configured substantially as described and illustrated in U.S. Application Publication No. 2020/0217,635 published Jul. 9, 2020, which is incorporated herein by reference in its entirety. The bulkhead 226 may be configured as an electrical connector. According to an aspect, the electrical connector includes a connector body and a first electrical contact/pin provided at a first end of the connector body. The first electrical contact may be biased so as to rest at a first rest position if no external force is being applied to the first electrical contact. The first electrical contact may be structured so as to move from the first rest position to a first retracted position in response to an application of external force against the first electrical contact.

The method may also include features and functionality as discussed above in connection with the various embodiments of the TSA 200.

An exemplary embodiment of a tool string 500 may include a plurality of perforating guns 213A, 213B, 213C (collectively 213). As illustrated in FIG. 8, a TSA 200, configured substantially as described hereinabove, may be positioned between each adjacent perforating gun 213. Each perforating gun of the plurality of perforating guns 213 may include one or more shaped charges 402. The TSA 200 includes a housing 210 having a first end 212 adapted to be connected to a first of the connected perforating guns 213B and a second end 214 adapted to be connected to a second of the connected perforating guns 213C. A port 216 extends through a wall of the housing 210 from an exterior of the housing 210 to an interior of the housing 210, and is in communication with an interior 217 of the first of the connected perforating guns 213B. A tracer material 218 is arranged in the port 216, and a retainer 220 secures the tracer material 218 within the port 216. Upon detonation of the one or more shaped charges 402 within the perforating gun 213B (for example), the retainer 220 is displaced and the tracer material 218 is expelled from the port 216.

The tandem seal adapter 200 of the tool string 500 may also include the features and functionality as discussed above in connection with the various embodiments of the TSA 200 and method described hereinabove.

In embodiments which include a tool string 500 that includes multiple perforating guns connected to each other by TSAs 200, each TSA 200 may include a different type of tracer material in order to provide an indication as to which perforating zone was activated in the wellbore.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A tandem seal adapter comprising:

a housing having a first end adapted to be connected to a first perforating gun and a second end adapted to be connected to a second perforating gun;

a port extending through a wall of the housing from an exterior of the housing to an interior of the housing, wherein the port is configured to be in communication with an interior of the first perforating gun;

a tracer material positioned in the port; and a retainer positioned in the port, adjacent the tracer material, wherein, upon detonation of the first perforating gun, the retainer is displaced and the tracer material is expelled from the port by gas pressure produced by the detonation.

2. The tandem seal adapter of claim 1, further comprising:

a pathway extending from the first end of the housing to the port, the pathway being in communication with the interior of the first perforating gun, wherein pressurized gas from the detonation travels along the pathway to the tracer material upon detonation of the first perforating gun.

3. The tandem seal adapter of claim 2, further comprising:

a cavity extending along a longitudinal axis of the housing, between the first end and the second end; and a bulkhead arranged in the cavity for pressure sealing the first perforating gun from the second perforating gun, wherein the pathway is parallel to and spaced apart from the cavity.

4. The tandem seal adapter of claim 3, wherein the port extends in a radial direction from the pathway.

5. The tandem seal adapter of claim 1, wherein the retainer comprises a plug inserted into the port from the exterior of the housing.

6. The tandem seal adapter of claim 5, wherein the plug is press fit into the port.

7. The tandem seal adapter claim 5, wherein:

the port comprises a first radial bore which extends into the interior of the housing and which is partially fillable with the tracer material and a second radial bore which is larger than the first radial bore and which extends from the first radial bore towards the exterior of the housing; and the plug comprises a body portion and a head portion, wherein the head portion has an outer diameter that is larger than an outer diameter of the body portion, and the body portion extends partially into the first radial bore and the head portion is positioned within the second radial bore.

8. The tandem seal adapter of claim 7, wherein the body portion comprises one or more protrusions in engagement with an inner wall of the first radial bore.

9. The tandem seal adapter of claim 7, further comprising:

one or more sealing members secured to the body portion, where the one or more sealing members are configured for prevent wellbore fluids from entering the first radial bore.

10. The tandem seal adapter of claim 1, further comprising:

a rib extending radially from the wall of the housing, between the first end and the second end, wherein the port extends through a portion of the rib.

11. The tandem seal adapter of claim 1, wherein the retainer is pressure resistant against pressures in a wellbore towards an interior of the housing and adapted to maintain a pressure rating of the first perforating gun.

12. A method of using a tandem seal adapter for a perforating gun assembly to disperse tracer material into a wellbore, the method comprising:

connecting at least a first perforating gun to a tandem seal adapter, wherein the tandem seal adapter comprises a first housing end, a second housing end, a port extending through a wall of the housing from an exterior of the housing to an interior of the housing, a tracer material positioned in the port, and a retainer positioned in the port, adjacent the tracer material;

detonating a shaped charge positioned in the first perforating gun to create a detonating pressure; and using the detonating pressure, displacing the retainer and expel the tracer material out of the port and into the wellbore.

13. The method of claim 12, further comprising:

providing a pathway extending from the first end of the housing to the port for connecting the port to the interior of the first perforating gun, wherein pressurized gas from the detonation travels along the pathway upon detonation of the first perforating gun.

14. The method of claim 13, further comprising:

providing a cavity which extends within the housing between the first end and the second end; and pressure sealing the first perforating gun from the second perforating gun via a bulkhead arranged in the cavity, wherein the pathway extends parallel to and spaced apart from the cavity.

15. The method of claim 14, wherein the cavity extends along the longitudinal axis of the housing, and the port extends in a radial direction from the pathway.

16. The method of claim 12, wherein the retainer is press fit into the port.

17. A tool string, comprising:

a plurality of connected perforating guns, each of the connected perforating guns comprising at least one explosive charge;

a tandem seal adapter connected between every two connected perforating guns of the plurality of connected perforating guns, wherein the tandem seal adapter comprises:

a housing having a first end adapted to be connected to a first connected perforating gun of the plurality of connected perforating guns and a second end adapted to be connected to a second connected perforating gun of the plurality of connected perforating guns;

a port extending through a wall of the housing from an exterior of the housing to an interior of the housing in communication with an interior of the first connected perforating gun of the plurality of connected perforating guns;

a tracer material arranged in the port;

a retainer for securing the tracer material in the port;

wherein the retainer is displaced and the tracer material is expelled from the port upon detonation of the first connected perforating gun by gas pressure produced by the detonation.

18. The tool string of claim 17, further comprising:

a pathway extending from the first end of the housing to the port for connecting the port to the interior of the first connected perforating gun, wherein pressurized gas from the detonation travels along the pathway upon detonation of the first connected perforating gun.

19. The tool string of claim 17, wherein the retainer comprises a plug inserted into the port from the exterior of the housing.

* * * * *